US008769884B2

(12) United States Patent
Picchio

(10) Patent No.: US 8,769,884 B2
(45) Date of Patent: Jul. 8, 2014

(54) SELF-SUPPORTING MODULAR PANEL FOR OFFICE FURNISHING

(75) Inventor: Cesare Picchio, Vedano al Lambro (IT)

(73) Assignee: Unifor S.p.A., Turate (CO) (IT)

( * ) Notice: Subject to any disclaimer, the term of this patent is extended or adjusted under 35 U.S.C. 154(b) by 4 days.

(21) Appl. No.: 12/954,724

(22) Filed: Nov. 26, 2010

(65) Prior Publication Data

US 2011/0289859 A1 Dec. 1, 2011

(30) Foreign Application Priority Data

Nov. 25, 2009 (IT) ..... MI2009A2077

(51) Int. Cl.
*E04B 2/74* (2006.01)
*A47F 5/08* (2006.01)

(52) U.S. Cl.
CPC ..... *A47F 5/0846* (2013.01)
USPC ..... 52/36.5; 52/36.1; 52/239

(58) Field of Classification Search
USPC ..... 52/239, 36.1, 36.5, 36.6, 220.7, 36.4, 52/238.1, 263, 264, 265
See application file for complete search history.

(56) References Cited

U.S. PATENT DOCUMENTS 4,821,477 A * 4/1989 Rydqvist ..... 52/239
5,881,500 A * 3/1999 Latino et al. ..... 52/36.1
6,164,467 A * 12/2000 DePottey et al. ..... 211/189
6,344,610 B1 * 2/2002 Berndt ..... 174/505
6,427,389 B1 * 8/2002 Branc et al. ..... 52/36.1
6,460,470 B1 10/2002 Scharer et al.
7,908,805 B2 * 3/2011 Metcalf et al. ..... 52/239
7,926,231 B2 * 4/2011 Laukhuf ..... 52/239
7,958,683 B2 * 6/2011 Abusada et al. ..... 52/239
2005/0005527 A1 * 1/2005 Metcalf et al. ..... 52/36.1

FOREIGN PATENT DOCUMENTS

WO 2004/036060 4/2004

* cited by examiner

*Primary Examiner* — William Gilbert
*Assistant Examiner* — Gisele Ford
(74) *Attorney, Agent, or Firm* — Robert E. Alderson, Jr.

(57) ABSTRACT

A self-supporting modular panel for dividing spaces and/or supporting furniture elements includes a support structure including a cross-beam and an upright fastened to the cross-beam. The support structure has a plurality of horizontal notches. A first plurality of cover sheets are fastened to the cross-beam so as to provide a rest base, and define a housing volume arranged within the rest base. A second plurality of cover sheets are fastened to the upright of the modular support structure so as to provide a wall having plurality of horizontal grooves which provide a passageway for a bracket mount which can be geometrically coupled to a shaped profile that is accommodated within one of the horizontal notches of the support structure. The rest base, with the housing volume, defines a wiring recess suitable to accommodate a plurality of wires.

7 Claims, 8 Drawing Sheets

SELF-SUPPORTING MODULAR PANEL FOR OFFICE FURNISHING

FIELD OF THE INVENTION

The object of the present invention is a self-supporting modular panel, particularly for office furnishing, forming a base element for an assembly employed for dividing spaces and/or as a support element for other furniture means.

BACKGROUND OF THE INVENTION

Modular panels for furnishing are used for dividing a room into many environments, in which it is not wished to intervene with wall elements and also offer the possibility of being able to modify this division easily by moving the panels themselves. Moreover, they are used as base modules for creating a wide variety of furniture, for example, for the office.

The modular panels of the prior art, although satisfactory from many points of view, still have drawbacks. Indeed, said panels have been developed without sufficiently taking into account the multitude of wires used today for transporting electric energy and for transporting other signals, such as, telephone signals or those relative to data network or others. Attempts have been made to house electric and electronic units into systems with modular panels, but with only limited success since they are not able to ensure the housing of a sufficient amount of wiring and causing the appearance of the furniture themselves to be displeasing. Moreover, such modular panels are usually thin and fragile acting as simple dividers that typically have scarce structural rigidity and limited stability.

The purpose of the present invention is that of devising and providing a self-supporting modular panel that makes it possible to avoid the aforementioned drawbacks with reference to the prior art.

In particular, the task of the present invention is that of providing a self-supporting modular panel that is structurally capable of withstanding heavy loads of, for example, writing desk planes, shelves and other types of suspended wall units fastened to it.

A further purpose of the present invention is that of providing a self-supporting modular panel that can house numerous wirings making it very easy for them to be used by various devices that are connected to them.

In addition, the purpose of the present invention is to provide a self-supporting modular panel that is easy to manufacture and assemble and that is very safe and stable.

SUMMARY OF THE INVENTION

Such a purpose and such tasks are achieved with a self-supporting modular panel in accordance with claim 1. Preferred embodiments of the invention are defined in the dependent claims.

According to a general embodiment of this invention, a self-supporting modular panel which is, during use, a base element for an assembly employed for dividing spaces and/or as a support element for other furniture means, comprises a modular support structure comprising a cross-beam suitable to be substantially arranged parallel and proximate to a rest plane of an environment, such as, for example, a floor.

Said modular support structure further comprises an upright fastened to said cross-beam and suitable to extend substantially perpendicular to the rest plane.

Said modular support structure comprises a plurality of horizontal notches.

The self-supporting modular panel comprises a first plurality of cover sheets suitable to be fastened to the cross-beam of the modular support structure such as to provide a rest base, defining a housing volume arranged within the rest base;

The self-supporting modular panel comprises a second plurality of cover sheets suitable to be fastened to the upright of the modular support structure such as to provide a wall.

According to the invention, the wall comprises a plurality of horizontal grooves which are suitable to provide a passageway for a bracket mount which is suitable to be geometrically coupled to a channel (or "shaped profile" below) that is accommodated within one of the plurality of horizontal notches of the modular support structure and wherein the rest base, with the housing volume, defines a wiring recess suitable to accommodate a plurality of wirings.

Advantageously, the cross-beam comprises a tubular portion that is suitable to be arranged parallel to the rest plane and further tubular portions, which are suitable to extend towards the rest plane and to abut against the rest plane such as to allow the tubular portion of the cross-beam to move away from the rest plane such as to make the wiring recess.

In accordance with an embodiment, sheets of the first plurality of cover sheets of the rest base comprise at least one opening associated with removable closure, said opening with removable closure defining at least one wiring housing suitable to provide a passageway for at least one wiring of the plurality of wirings which from the wiring recess is suitable to be connected to devices provided outside said wiring recess or to allow for the passage of at least one wiring of the plurality of wirings suitable to energize the wirings provided in the wiring recess.

In accordance with an embodiment, said shaped profile comprises an undercut coupling surface suitable to be removably geometrically coupled to the bracket mount.

Advantageously, said shaped profile is suitable to accommodate the bracket mount which is suitable to be fastened to wall units, writing desks and the like which thereby result to be secured to the wall of the self-supporting modular panel.

In accordance with an embodiment, the rest base comprises two base portions extending in opposite directions, in a direction parallel to the axis of development of the cross-beams, relative to the point where the wall is fastened to the rest base such as to ensure high stability of the self-supporting modular panel.

Advantageously, the rest base is mostly extended in the direction parallel to the axis of development of the cross-beams, relative to the extension, in the same direction, of the wall such as to ensure a considerable stability to the self-supporting modular panel even when hanging loads are provided, which are connected to the wall.

In accordance with an embodiment, the profile of a section of the same self-supporting modular panel along a plane perpendicular to the axis of development of the self-supporting modular panel is substantially in the shape of an inverted "T" in which the portion suitable to be parallel to the rest plane consists of the rest base whereas the portion suitable to be parallel to the axis of development of the uprights is the wall.

In accordance with an embodiment, a multiple work station comprises a self-supporting modular panel, as already mentioned, and at least one writing desk being fixed, at one end thereof to the self-supporting modular panel.

BRIEF DESCRIPTION OF THE DRAWINGS

Further characteristics and advantages of the device according to the invention shall become clearer from the following description of preferred embodiments, given as an example and not for limiting purposes with reference to the attached figures, in which.

DETAILED DESCRIPTION OF THE INVENTION

Figure 1:
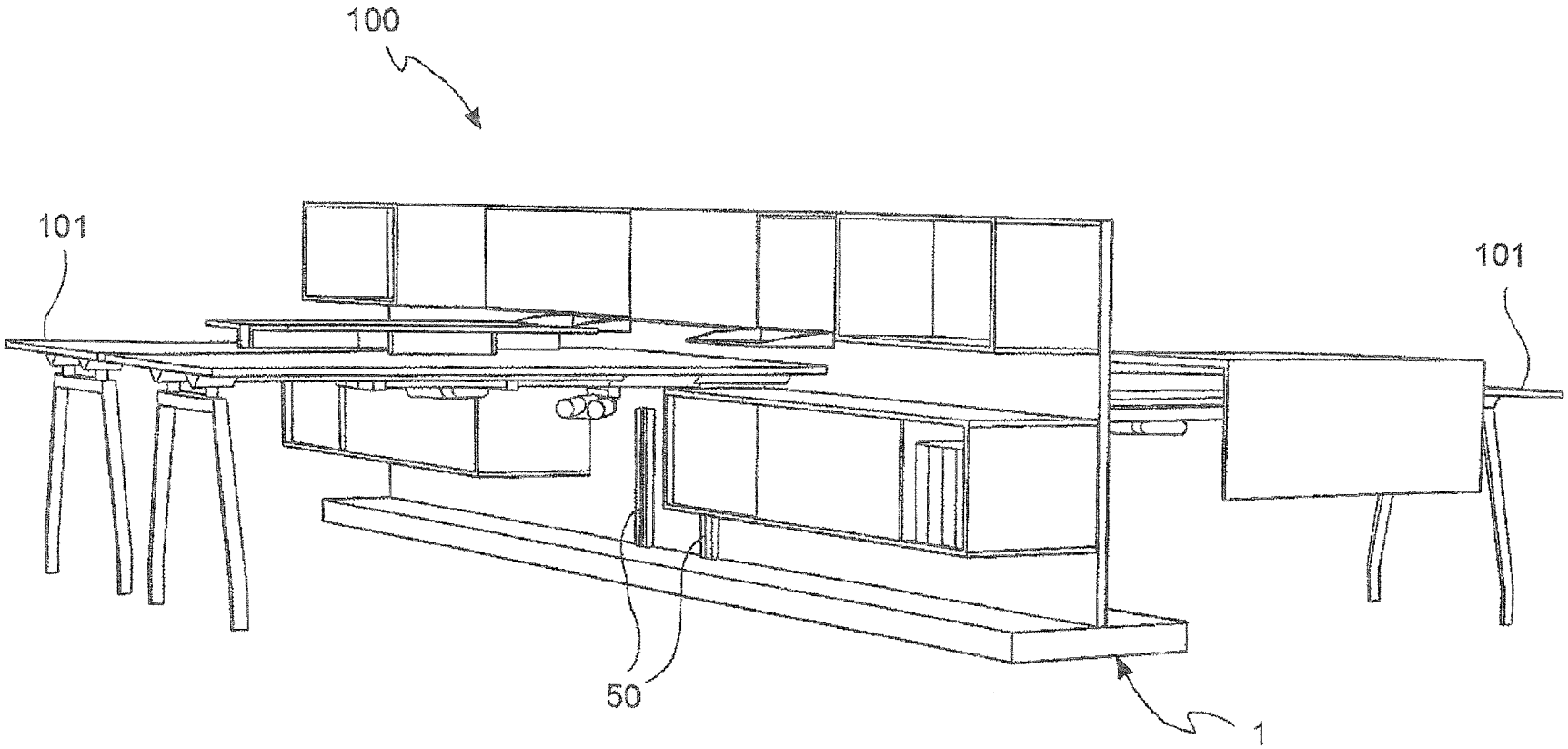
FIG. 1 illustrates a view of the self-supporting modular panel according to the invention to which furnishing elements for the office, such as wall units, writing desk planes and the like are connected.

With reference to the aforementioned figures, a self-supporting modular panel according to the invention is wholly indicated with reference numeral 1. The self-supporting modular panel 1 comprises modular support structures 2 that form the workframe of the self-supporting modular panel 1 and a first and second plurality of cover sheets 5 and 27 that are removably fastened by fastening means or immovable, for example, through welding, to surfaces of the modular support structures 2.

Figure 4:
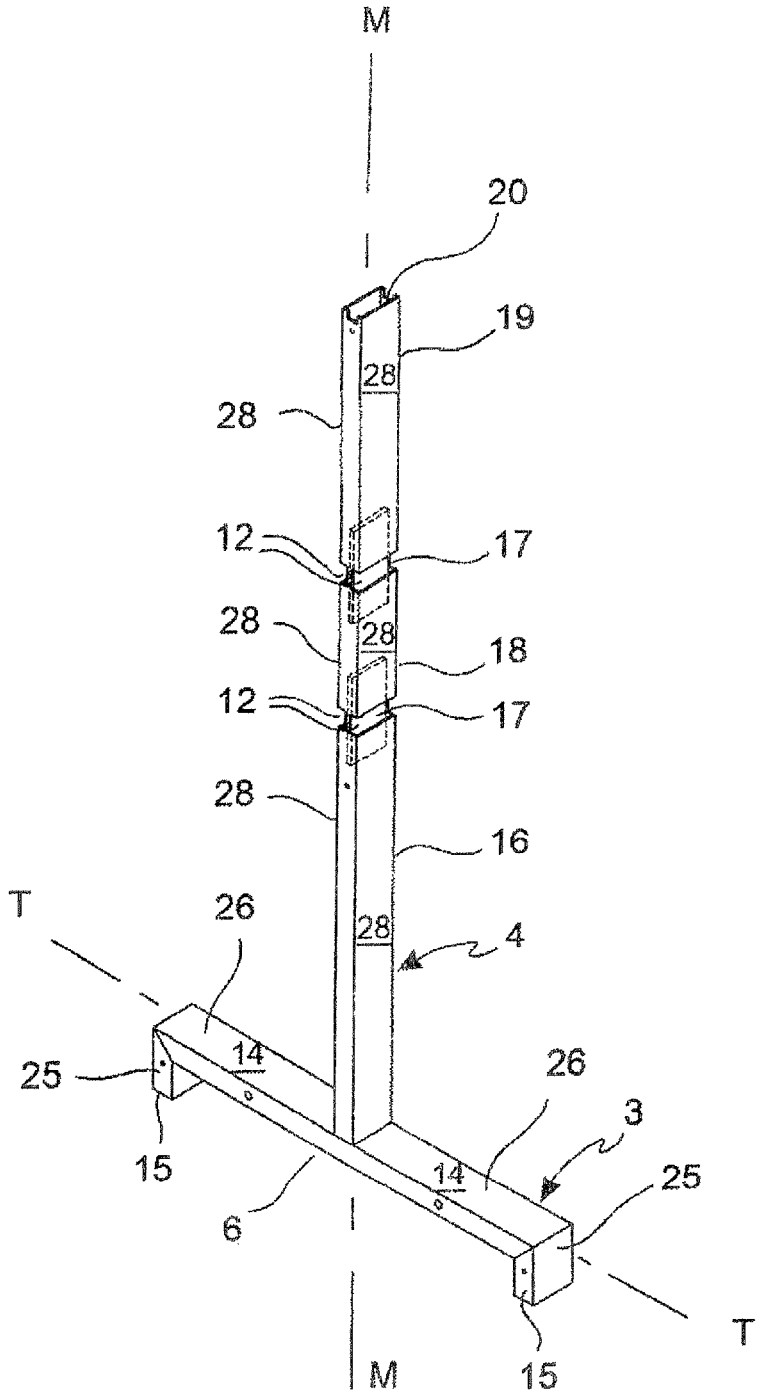
FIG. 4 illustrates an axonometric view of a modular support structure.
Figure 5:
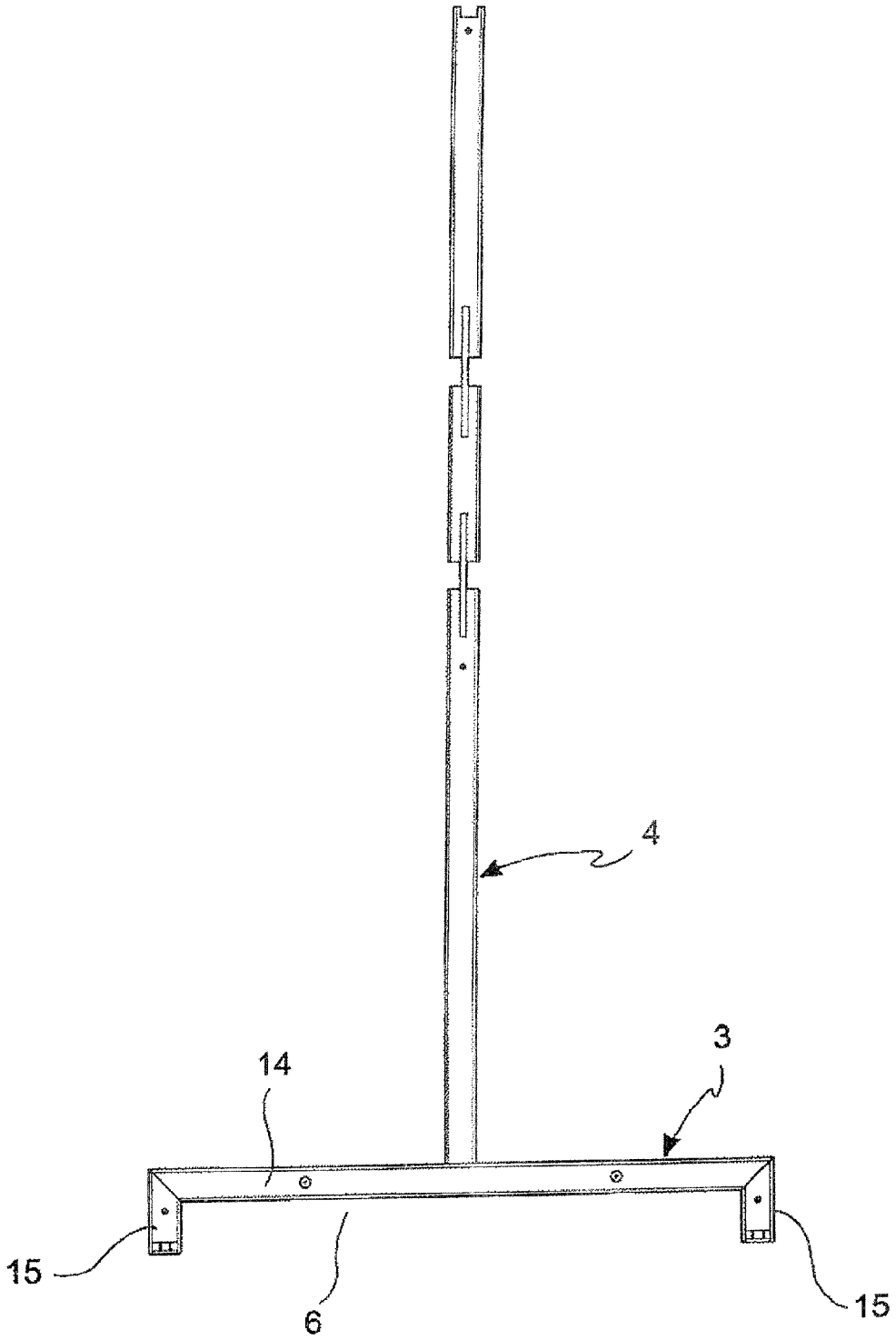
FIG. 5 illustrates an orthogonal view according to a plane that is perpendicular to the axis P-P of the modular support structure of FIG. 4.

With reference to FIG. 4, the modular support structure 2 comprises a cross-beam 3 parallel to a rest plane, not shown in the figures, for example a flooring of a house or of an office. Preferably, such a cross-beam 3 is a metal tube that ensures high rigidity and strength of the structure, and comprises, in addition to the tube portion 14, which is parallel to the rest plane, also further portions of tube 15 that are perpendicular to the previous portions and that extend towards the rest plane against which they abut.

Preferably such further tubular portions 15 comprise foot seats, not shown in the figures, suitable to accommodate feet suitable to ensure a stable rest for the modular support structure 2 with respect to the rest plane.

Such a tubular portion 14 and said further tubular portions 15 are fastened irremovably to each other, preferably through welding, so that the further tubular portions 15 are preferably fixed at the ends of the tubular portion 14.

To the tubular portion 14 of the cross-beam 3, an upright 4 that extends perpendicular with respect to the cross-beam 3 towards the direction opposite with respect to the direction of the further tubular portions 15, is also fastened in an irremovable manner, preferably through welding. In other words, the upright 4 extends from the cross-beam 3 perpendicular with respect to the rest plane.

Preferably, the upright 4 is fastened in the part central with respect to the opposite end of the tubular portion 14 of the cross-beam 3 so that the modular support structure 2 is stable and capable of withstanding heavy loads.

In particular, the cross-beam 4 comprises a hooking tube portion 16 that is connected to its end, in an irremovable manner, preferably through welding, to the cross-beam 3 and that is connected to the opposite end to a pin element 17.

Such a pin element 17 is suitable to removably fasten, for example through fixing means, or in an irremovable manner, for example through welding, two portions of the plurality of tubular portions forming the upright 4. Said pin element 17 is preferably a metallic sheet that comprises a smaller thickness with respect to the thickness of the tube forming the upright with respect to the development axis of the cross-beam T-T, whereas the dimension perpendicular to the axis T-T is substantially equal to the respective dimension of the tube upright.

In particular, as visible in the example of FIG. 4, the pin element 17 connects the hooking tube portion 16 with one of the plurality of tube portions 18 or connects two portions of the plurality of tube portions 18 so as to form a plurality of horizontal notches 12, respectively one notch for each connection.

This plurality of horizontal notches 12 is determined, as defined previously, by the different dimensions of the reference pin 17 with respect to those of the plurality of tube portions, or of the hooking tube, or of a final tube 14, 18, 19 along the direction parallel to the axis T-T of development of the cross-beams.

The pin element 17 has its opposite ends, in the direction parallel to an axis M-M of development of the upright 4, partially received by two of the adjacent tubular portions 14, 18, 19 so that the central part of said pin element 17 makes it possible to define one of the plurality of horizontal notches 12.

Through the pin element 17 two notches of the plurality of horizontal notches 12, one for each face of the upright 4 perpendicular to the axis T-T, are thus formed.

Advantageously, thanks to the connection realized by the pin element 17 it is possible to create said horizontal notches 12 that receive a shaped profile 31 without enlarge the width of the final structure of the self-supporting modular panel 1. It is also possible to determine a strong constraint between the shaped profile 31 and the modular support structure 2 that can allow to suspend heavy load to the self-supporting modular panel 1.

Figure 7:
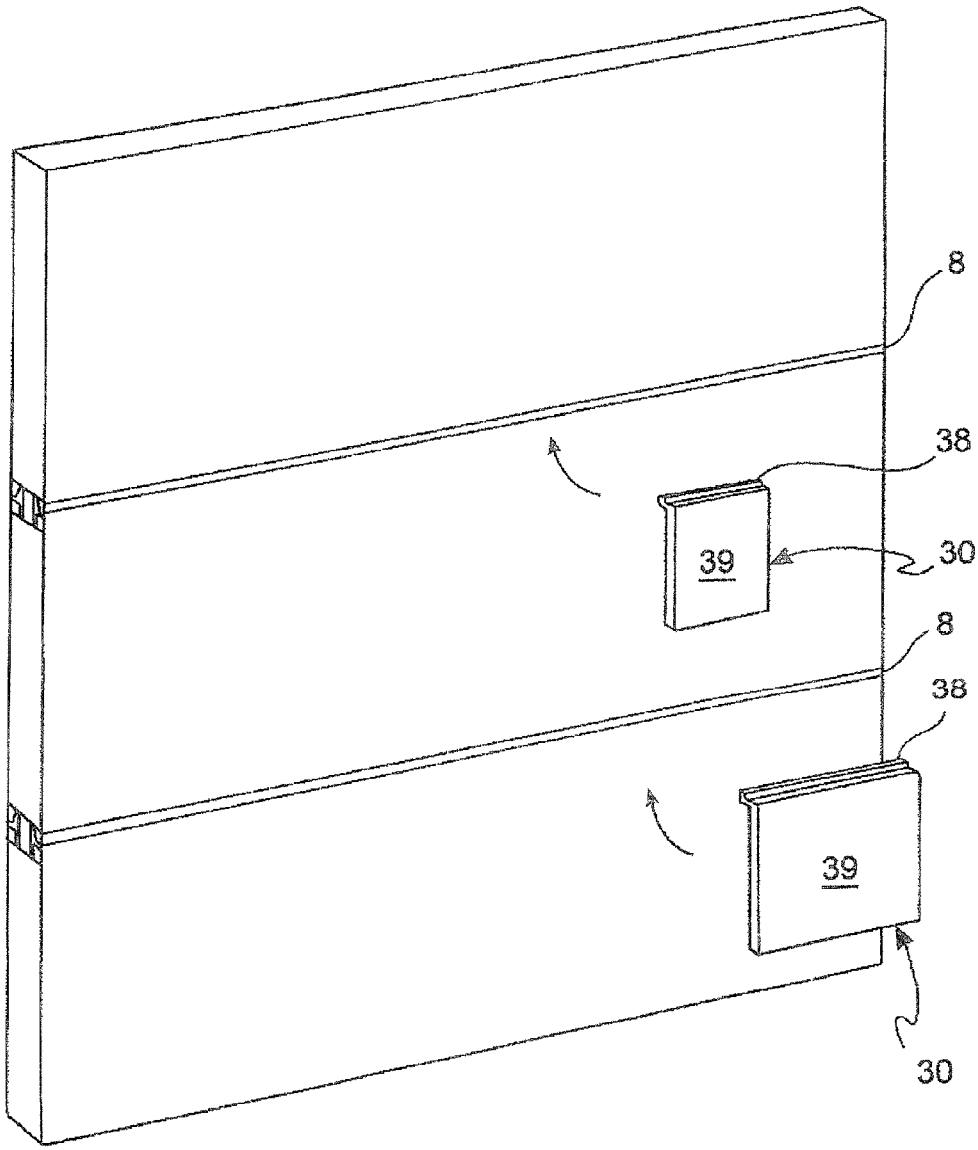
FIG. 7 illustrates a partial axonometric view of the self-supporting modular panel of FIG. 6 with bracket mounts that are clearly visible and not fastened to the self-supporting modular panel.

As clearly visible in FIG. 7, the particular assembly of the shaped profile 31 with the modular support structure 2 allows to get an integrated solution that permits a simple connection of furniture elements to the self-supporting modular structure 1, like as writing desk, bracket, etcetera.

The upright 4 moreover comprises a final tubular portion 19 that comprises, at its end opposite with respect to the cross-beam 3, one profile seat 20 suitable to house a closing profile 21, visible in FIG. 1. Such a closing profile 21 is removably fastened to such a profile seat 20 and extends parallel to the direction of development of the self-supporting modular panel 1 indicated with the axis P-P, so as to define the closure of the upper side of the self-supporting modular panel 1.

Figures 2, 2A:
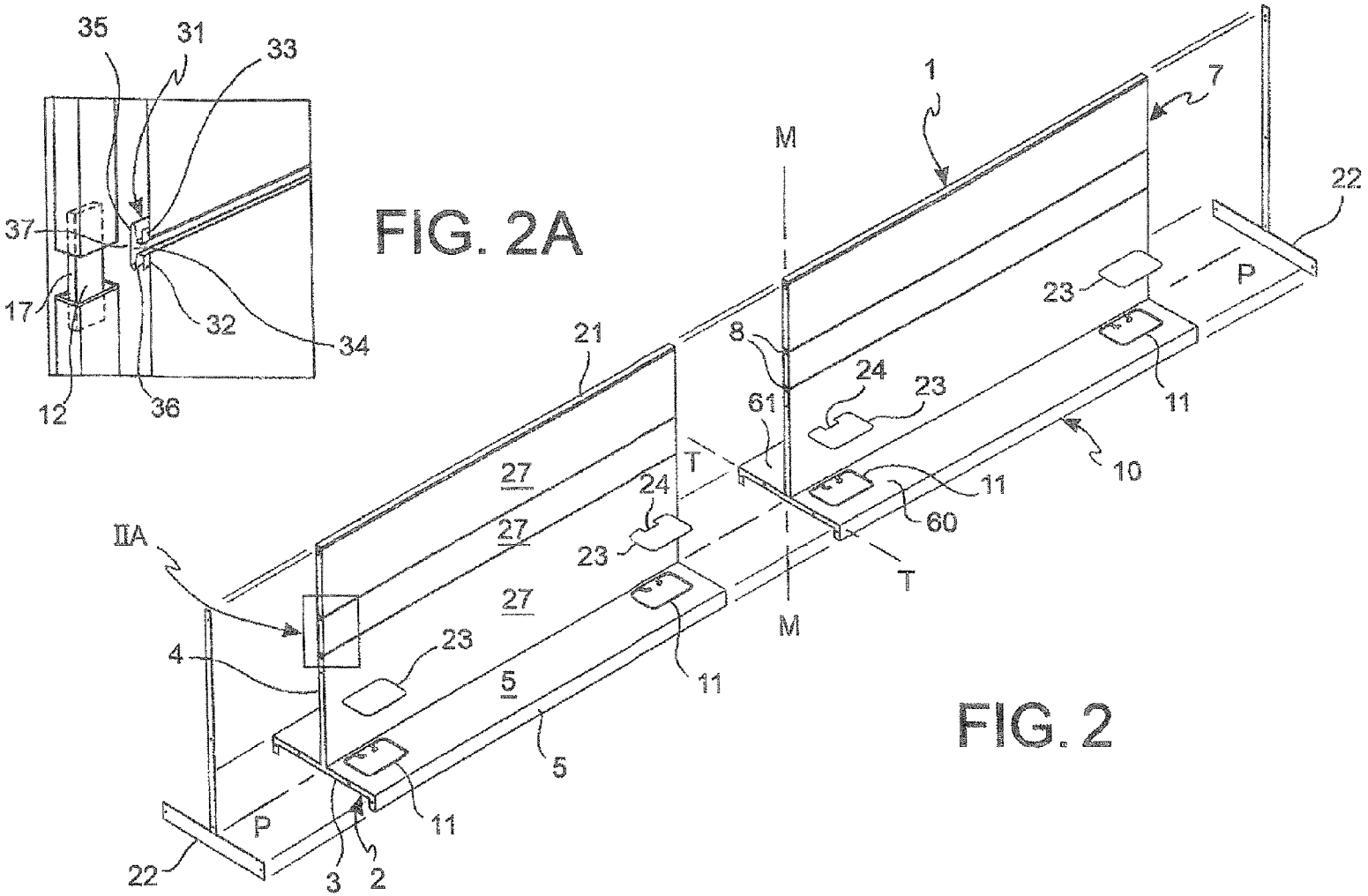
FIG. 2 illustrates an axonometric view of a self-supporting modular panel with the components separated.
FIG. 2A illustrates a detail indicated with IIA in FIG. 2 that is enlarged for the sake of clarity.

The self-supporting modular panel 1 comprises a plurality of modular support structures 2, which like in the example shown in FIG. 2 are, for example four in number, equally spaced along the entire extension of the panel 1 along the axis P-P.

In particular there is a modular support structure 2 at both the ends of the self-supporting modular panel 1 and there are also two other modular support structures 2 inside the panel preferably arranged so as to be equally spaced apart along the axis P-P.

The first plurality of cover sheets 5 is fastened to the surfaces, facing outwards, of the cross-beams 3 so as to form a rest base 10.

In greater detail, sheets of the first plurality of cover sheets 5 are fastened respectively to the outer surfaces 26 of the tubular portion 14, where such outer surfaces 26 are suitable to be arranged parallel to the rest surface and face outwards from the modular support structure 2. Moreover, sheets of the first plurality of cover sheets 5 are fastened on the side surfaces 25 of the further tubular portions 15, where such side surfaces 25 are suitable to be arranged perpendicular with respect to the rest plane and suitable to face towards the outside of the modular support structure 2.

In this way the assembly of cross-beams 3 and of the first plurality of cover sheets 5 are suitable to form the rest base 10.

The rest base 10 comprises a wiring recess 6 suitable to accommodate wirings that extends along the entire length of the panel in the direction P-P.

In particular, the wiring recess 6 is determined by the configuration of the cross-beam 3 that determines a volume between the tubular portion 14 and the rest surface thanks to the use of the further portions of tube 15, which, as already described, are perpendicular to the portion of tube 14 and make it possible to lift the portion of tube 14 of the cross-beam 3 with respect to the rest plane so as to create the wiring recess 6.

The wiring recess 6 extends for the entire length of the self-supporting modular panel 1, since it is formed by the modular support structures 2 and by the first plurality of cover sheets 5 that connect the various cross-beams 3 so as to form the rest base 10.

The rest base 10, on its surface suitable to be arranged parallel to the rest plane, comprises wiring housings 11 suitable to provide a passageway for the wirings that from the wiring recess 6 are suitable to be connected to various devices, such as processors, telephones and the like. Moreover, such wiring housings 11 make it possible to inspect the wiring recess 6 and to facilitate the insertion and the correct arrangement of such wirings (as visible in FIG. 8).

In other words, sheets of the first plurality of cover sheets 5 of the rest base comprise at least one opening associated with removable closure elements. Said opening with removable closure defines at least one wiring housing 11 suitable to provide a passageway for at least one wiring of the plurality of wirings 29 that from the wiring recess 6 is suitable to be connected to devices foreseen outside said wiring recess 6 or to provide the passageway of at least one wiring of the plurality of wirings 29 suitable to energize the wirings provided in the wiring recess 6. For example, such wirings are suitable to connect devices such as processors, desk lamps and telephones or the like that are on the writing desk connected to the self-supporting modular panel 1. Advantageously, such wirings are suitable to convey, for example, electric current from one point to the other of the environment in which the panel is installed, passing through the wiring recess 6.

Figure 3:
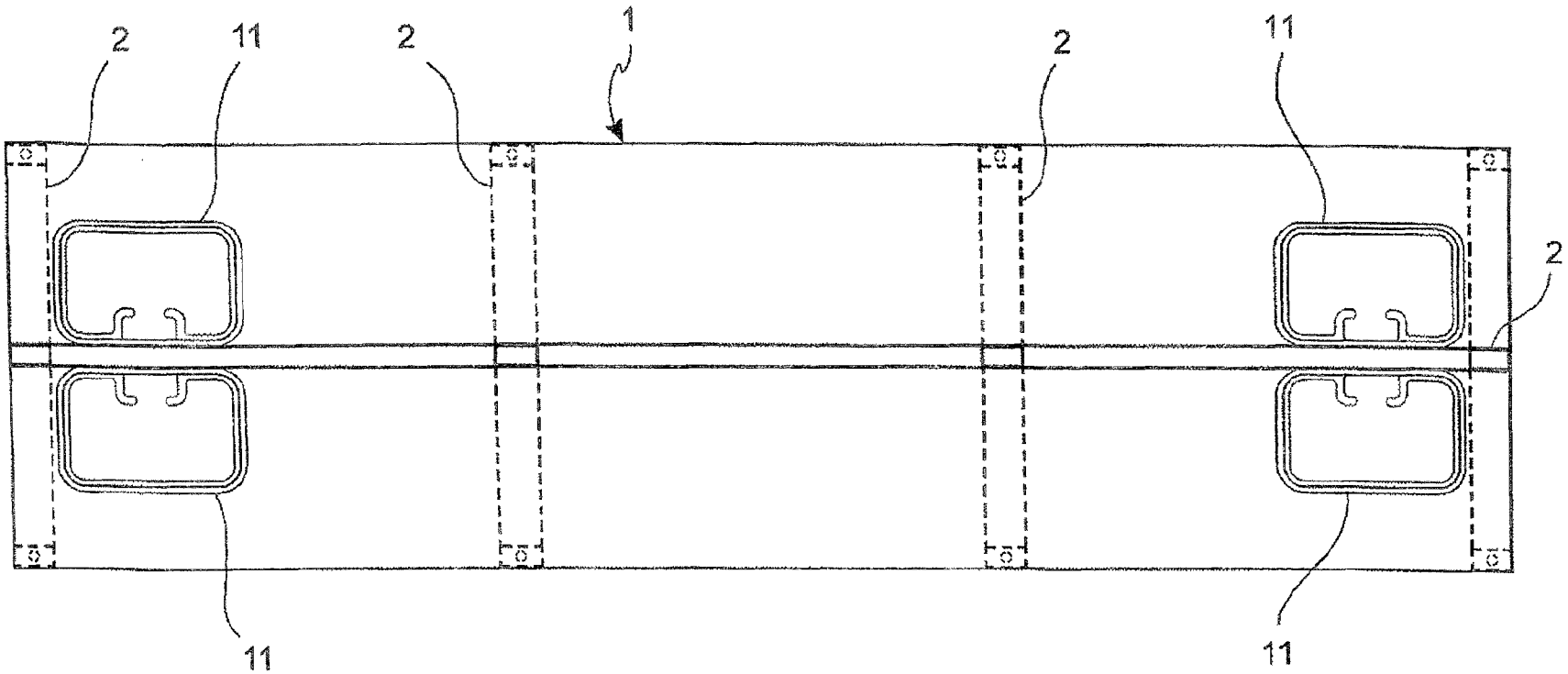
FIG. 3 illustrates a plan view of a self-supporting modular panel.

With reference to FIGS. 2 and 3, the wiring housings 11 arranged on the surface of the rest base 10 have a substantially rectangular plan and comprise closure covers 23, suitable to be arranged on the same wiring housings 11 so as to ensure the closure of said wiring housings 11. In particular, said closure covers 23 comprise an opening for wires 24 so as to provide a passageway of the wirings from the wiring recess 6 to the devices, suitable to be connected to such wirings, when said closure covers 23 are positioned on the wiring housings 11.

In an analogous way to the aforementioned configuration of the rest base 10, the second plurality of support sheets 27 are fastened to surfaces of the uprights 4 of the modular support structures 2 forming the wall 7 of the self-supporting modular panel 1.

In detail, sheets of the second plurality of cover sheets 27 are fastened on the further side surfaces of the hooking tube portion 16, of the plurality of tubular portions 18 and of the final tubular portion 19, where such side surfaces 28 are suitable to be arranged perpendicular with respect to the rest plane and to face along the direction of the axis T-T of development of the cross-beam 3.

Advantageously, the rest base 10 is stable and is capable of withstanding heavy loads hanging on the wall 7 thanks to the fact that it extends in a direction that is parallel to the axis T-T of development of the cross-beams more than the extension, in the same direction parallel to the axis T-T of development of the cross-beams, of the wall 7.

In other words, the wall 7 has a smaller thickness along the axis T-T with respect to the rest base 10. This makes it possible to ensure considerable stability to the self-supporting modular panel 1 even when there are hanging loads connected to the wall 7.

As visible in FIG. 2, the rest base 10 comprises base portions 60, 61 that extend in opposite directions, preferably along a direction parallel to the axis T-T of development of the cross-beams, with respect to the point in which the wall 7 is fastened to the rest base 10. This ensures a high stability of the self-supporting modular panel 1 and allows the wall 7 to support wall units hanging with respect to the rest plane without for this reason excluding the stability, due to the fact that the projection of the barycentre of the self-supporting modular panel 1 and hanging furniture assembly, falls in any case in the rest base 10.

In detail, in order to ensure stability, the barycentre of the aforementioned assembly, must fall inside the projection of the rest base 10 along a direction that is parallel to the axis M-M of development of the uprights. With reference to the example of FIG. 3, the projection of the rest base 10 on the rest plane is substantially a rectangle in which, in order to ensure the stability, the barycentre, of the assembly of the self-supporting modular panel 1 and of the hanging wall units fastened to it (not shown in FIG. 3), must be comprised.

Advantageously, the self-supporting modular panel, thanks to the structure with the rest base 10 extended along the rest plane, not only supports itself but is also stable when wall units or the like are fastened to it.

In addition, the profile of a section of the same self-supporting modular panel 1, along a plane perpendicular to the axis P-P of development of the self-supporting modular panel 1, is substantially in the shape of an inverted "T" in which the portion suitable to be parallel to the rest plane consists of the rest base 10, whereas the portion suitable to be parallel to the axis M-M of development of the uprights is the wall 7.

With reference to the example of FIG. 2, such a second plurality of support sheets 27 is made up of cover sheets that extend for the entire length of the self-supporting modular panel 1 along the axis P-P and are fastened to the respective portions of the upright 4 of each modular support structure 2 that acts as a frame for said panel 1.

Moreover, the wall 7 can comprise a plurality of cable troughs 50 that are removably fastened to the same wall 7 and that are suitable to receive the plurality of wirings 29. The plurality of cable troughs 50, when fastened to the wall 7, are suitable to be arranged parallel to the axis of development of the uprights M-M. In particular, each cable trough of the plurality of cable troughs 50 is arranged at the opening for wires 24 so as to receive the plurality of wirings 29 in outlet from or in inlet to the wiring housings 11.

As can be seen in FIG. 2, many self-supporting modular panels 1 can be used to form the desired structure. Indeed, it is sufficient to arrange two or more self-supporting modular panels 1 side by side, so as to align the modular support structures 2 that make up the ends of each panel along the axis P-P of development of the panel and fasten them through fixing means or in an irremovable manner through, for example, welding.

With reference to FIG. 2, the self-supporting modular panel also comprises closure sheets 22 that are removably fastened through fixing means, for example through screws, on the free ends along the axis P-P of the self-supporting modular panel or of a series of panels fastened to one another. Such closure sheets 22 are suitable to overlap the profile of the upright 4 and of the cross-beam 3.

In particular, the closure sheets 22 are suitable to close the wiring recess 6 along the direction parallel to the axis of development of the self-supporting modular panel P-P.

Figure 8:
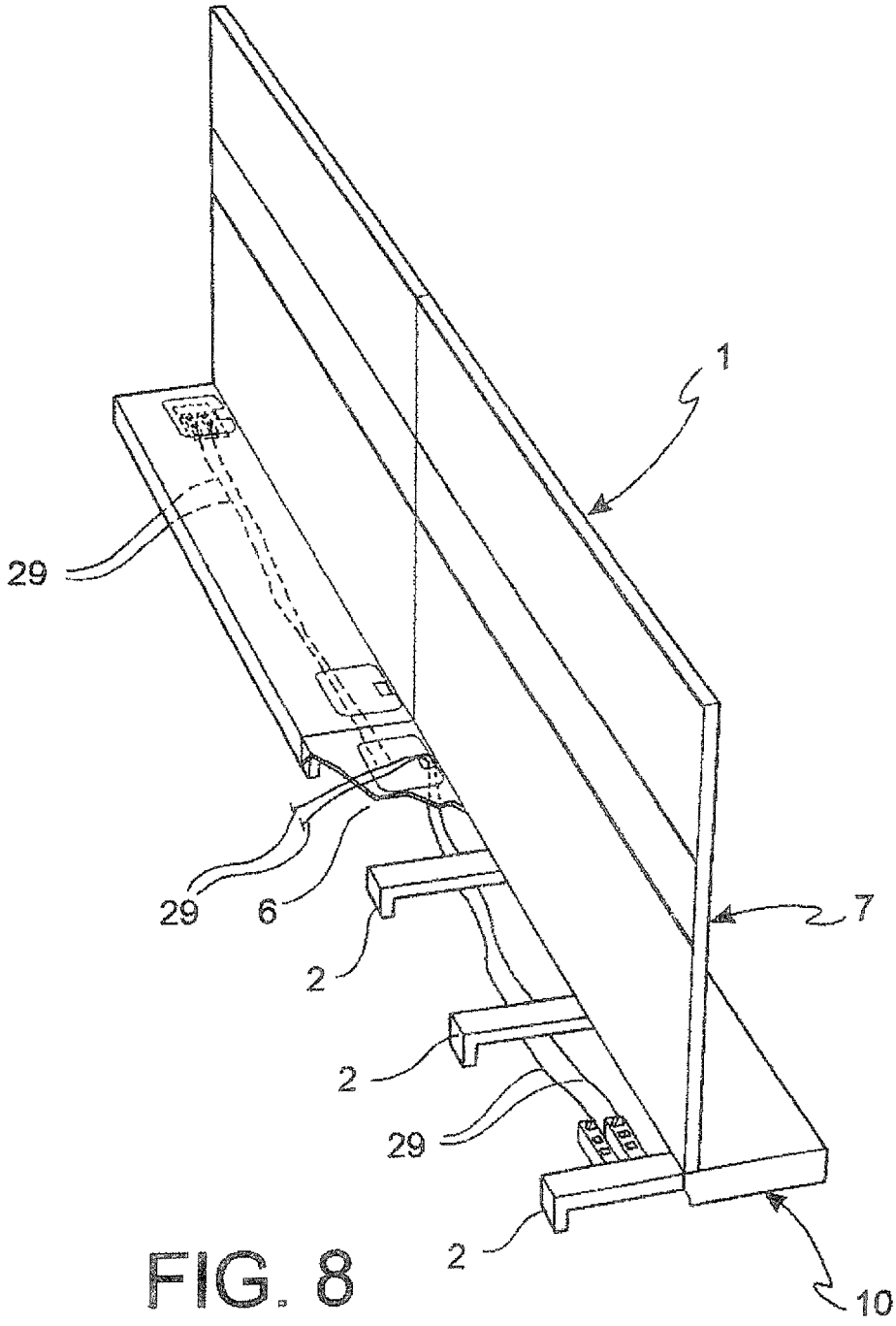
FIG. 8 illustrates a partially sectioned axonometric view of the self-supporting modular panel so as to show a wiring recess containing a plurality of wirings.

As shown in FIG. 8, the plurality of wirings 29 is received by the wiring recess 6 that, as already described, is comprised in the rest base 10. The plurality of wirings 29, through the opening for cables 24 of the closure covers 23, are suitable to be connected to various devices foreseen outside said wiring recess 6.

With reference to FIG. 2, at the plurality of horizontal notches 12 of the modular support structure 2, the wall 7 comprises a plurality of horizontal grooves 8 arranged parallel to the axis of development P-P of the self-supporting modular panel 1.

In particular, such a plurality of grooves 8 are defined by the arrangement of the second plurality of support sheets 27, which like in the example of FIG. 1 are 3 in number, which are not arranged contiguously in a direction that is parallel to the axis M-M of development of the upright 3, but between one sheet and the other of the second plurality of cover sheets 27, a space is left, which determines a passageway for a bracket mount 30 at each of the recesses of the plurality of horizontal recesses 12 provided in the modular support structure 2.

In another embodiment, not shown in the figures, the plurality of grooves are essentially openings in a direction parallel to the axis P-P of development of the panel made on the wall that, in this embodiment, can be for example made up of a single cover sheet. In other words, on such a cover sheet, horizontal grooves are made, for example through laser cutting, punching or milling, at each of the plurality of horizontal recesses.

Figure 6:
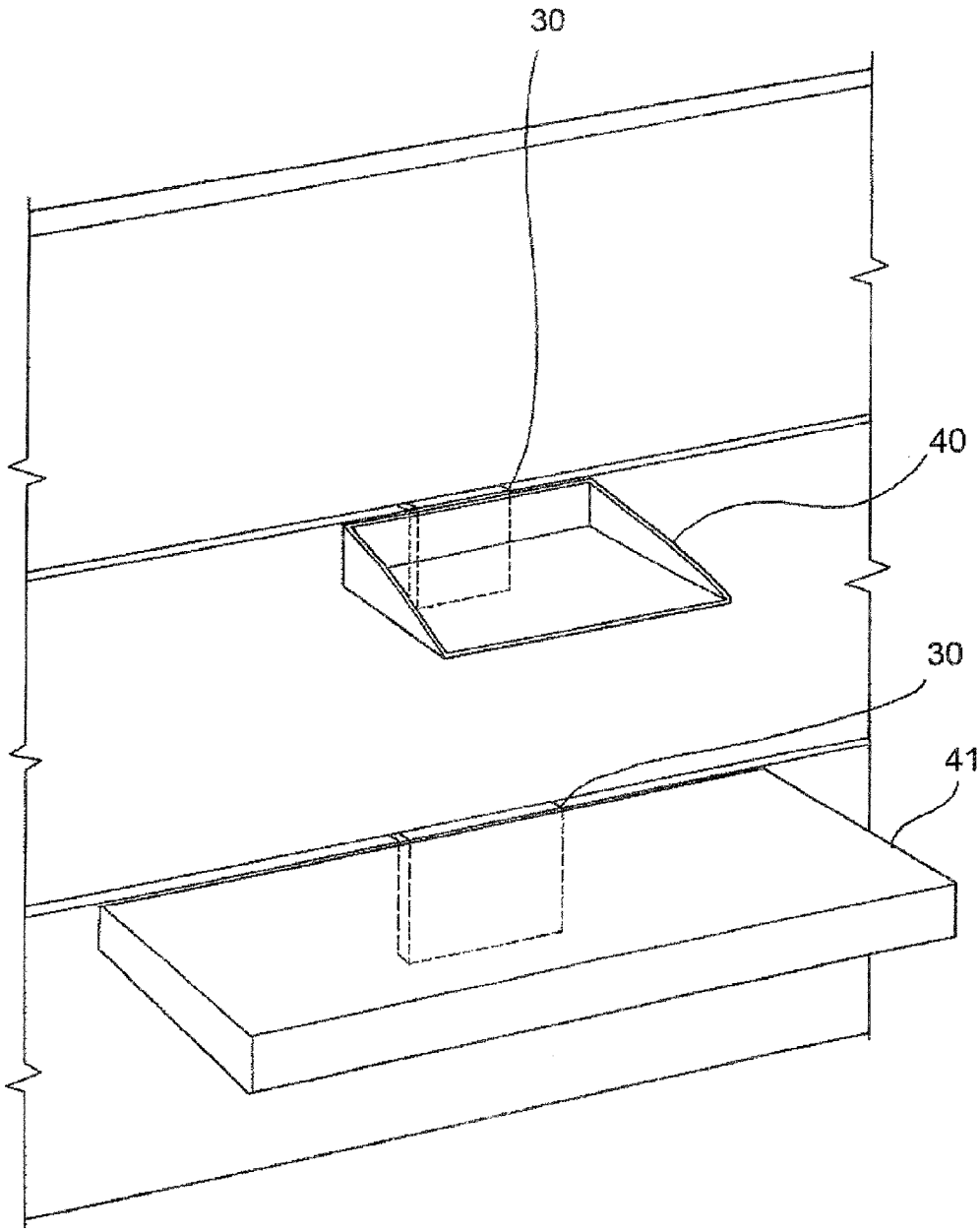
FIG. 6 illustrates an axonometric partial view of the self-supporting modular panel to which, as an example, a table top and an object holder are attached.

With reference now to FIGS. 2A, 6 and 7, inside the plurality of horizontal grooves 12 of the modular support structure 2, a shaped profile 31 is inserted that extends along the entire extension of the self-supporting modular panel 1 in a direction parallel to the axis P-P.

In detail, the shaped profile 31 is received by the horizontal recesses 12 of the modular support structures 2 making up the self-supporting modular panel 1. For example, with reference to FIG. 3, the shaped profile 31 is received by the horizontal recesses 12 of the four modular support structures 2. In particular, such horizontal recesses 12 are aligned along a direction that is parallel to the axis P-P of development of the panel.

In particular, the shaped profile is received, preferably, by at least two horizontal recesses of the modular support structures that make it possible to support it along the entire extension of the self-supporting modular panel.

Such a shaped profile 31 comprises a pair of planar portions 32 and 33 and a bridge portion 34 that form a unitary structure that can be made for example by extrusion or by bending a single metal sheet.

The pair of portions 32 and 33 comprise an upper planar portion 32 and a lower planar portion 33 and are connected, for example, through welding points, one to one sheet and the second to the adjacent sheet of the second plurality of cover sheets 27 so as to be positioned correctly at one of the pluralities of horizontal grooves 12.

In another embodiment, not shown in the figures, the planar portions are fastened to two portions of one same cover sheet across a horizontal groove formed in such a sheet.

The bridge portion 34 extends between the planar portions 32, 33 so as to define an upper curved portion 35 and a lower curved portion 36 and a channel portion 37. The upper curved portion 35 and lower curved portion 36 comprise, one towards the other, convex surfaces, in which the upper curved portion 35 extends from the upper planar portion 32 and the lower curved portion 36 extends from the lower planar portion 33. The channel portion 37 defines a concave surface that extends from the upper curved portion 35 to the lower curved portion 36.

As is clear in FIG. 2A, showing a detail of FIG. 2, the shape of the bridge portion 34 and of the planar portions 32, 33 are such that, when the shaped profile is observed along the axis of development of the panel P-P, it substantially seems omega-shaped.

With reference to FIG. 7, the bracket mount 30 can be for example extruded aluminium of a conventional manufacture, comprising a hooking portion 38 and a fixing portion 39. The hooking portion 38 is shaped so as to be suitable to create a geometrical coupling with the respective upper curved portion 35. The fixing portion 39 extends from such a hook portion and is suitable to abut against the wall 7 of the self-supporting modular panel 1, so that the bracket mount 30 is suitable to be received through one of the horizontal grooves 8 of the wall 7.

In addition, for example, wall units, writing desks and the like, which are per se suitable to be removably attached to the wall 7 of the self-supporting modular panel 1, can be fastened to the bracket mount 30.

It should be considered that different types of materials can be used in manufacturing the shaped profile 31, just like for the bracket mount 30, for example aluminium, steel or plastic material.

Moreover, the shaped profile 31, as described, can be irremovably fastened to the wall 7 of the panel through, for example, spot welding, riveting, gluing or also through removable fastening means for example through screws.

With reference to the shaped profile 31, as described, this has an omega-shaped profile but other profiles can be used to ensure the geometrical coupling with the bracket mount 30.

FIG. 6 shows a partial view of a self-supporting modular panel with two of the pluralities of horizontal grooves 8 in which through the geometrical coupling between the bracket mount 30 and the shaped profile 31, it is possible to connect, to the wall, in one case an object holder 40 and in the second case a table top 41 or for example a writing desk.

In the example of FIG. 1, a multiple work station 100 is shown comprising a self-supporting modular panel 1, as defined previously, and at least one writing desk 101 fastened, through an end thereof, to the self-supporting modular panel 1.

Moreover, the multiple work station 100 can comprise a wall unit, fastened to the self-supporting modular panel 1, which is hanging with respect to the rest plane, or in other words, it is supported by just the fastening with the self-supporting modular panel 1.

A man skilled in the art can bring modifications, adaptations and replacements of elements with other functionally equivalent elements to the embodiments of the device described above, in order to satisfy contingent requirements, without for this reason departing from the scope of the following claims. Each of the characteristics described as belonging to a possible embodiment can be made independently from other described embodiments.

The invention claimed is:

1. A self-supporting modular panel for dividing spaces and supporting furniture, said panel comprising:

a plurality of modular support structures, each comprising a cross-beam substantially arranged parallel and proximate to a floor, each said modular support structure further comprising an upright fastened to said cross-beam and extending substantially perpendicular to the floor, a first plurality of cover sheets extending parallel to the floor, fastened to the cross-beam of the modular support structure so as to provide a base, and to enclose a volume within the base;

a second plurality of cover sheets fastened to adjacent uprights so as to provide a wall extending in a longitudinal direction;

the base further comprising two base portions extending laterally in opposite directions from a point where the wall is fastened to the base so as to stabilize the self-supporting modular panel, and wherein said upright comprises one or more pin elements disposed between an upper tube element and a lower tube element, the pin element, upper tube element and lower tube element configured to form a horizontal notch, wherein the horizontal notch is adapted for receiving a shaped profile comprising an upper curved portion, a lower curved portion and a planar portion therebetween, and wherein the volume within the base defines a wiring recess suitable for accommodating wiring, the base having a width, transverse to said longitudinal direction, sufficient to provide stability to the self-supporting modular panel when hanging loads are connected to the wall.

2. The self-supporting modular panel according to claim 1, wherein the cross-beam comprises a tubular portion arranged parallel to the floor and tubular feet which extend towards the floor and abut against the floor so as to stand the tubular portion of the cross beam away from the floor in order to define the wiring recess.

3. The self-supporting modular panel according to claim 1, wherein the first plurality of cover sheets of the base comprise at least one opening associated with removable closure elements, each said opening with removable closure defining a wiring housing suitable for providing a passageway for wiring.

4. The self-supporting modular panel according to claim 1, wherein said channel has an undercut coupling surface for removably receiving the bracket.

5. The self-supporting modular panel according to claim 4, wherein the bracket is suitable for being fastened to wall units, writing desks and the like which may thereby be secured to the wall of the self-supporting modular panel.

6. The self-supporting modular panel according to claim 1, wherein the profile of a section of said self-supporting modular panel in a plane perpendicular to a longitudinal axis of the self-supporting modular panel is substantially in the shape of an inverted "T" wherein a portion of the panel parallel to the floor constitutes the base and a portion parallel to the longitudinal axis of the uprights is the wall.

7. A multiple work station comprising a self-supporting modular panel, so as defined in claim 1, and at least one writing desk being fixed at one end thereof to the self-supporting modular panel.

* * * * *